US005905217A

United States Patent [19]

Byers

[11] Patent Number: 5,905,217

[45] Date of Patent: May 18, 1999

[54] PICK HOLDER

[75] Inventor: Michael A. Byers, Atlanta, Ga.

[73] Assignee: Pick Pockets, Inc., Atlanta, Ga.

[21] Appl. No.: 08/864,134

[22] Filed: May 28, 1997

[51] Int. Cl.[6] ..... G10D 3/16

[52] U.S. Cl. ..... 84/322; 84/320; 84/321

[58] Field of Search ..... 84/322, 320, 321, 84/258, 453, 329; 248/309.2

[56] References Cited

U.S. PATENT DOCUMENTS

| | | | |
|---|---|---|---|
| D. 355,667 | 2/1995 | Burger | D17/20 |
| 3,302,917 | 2/1967 | Winkler | 248/317 |
| 4,785,708 | 11/1988 | Vaughan | 84/329 |
| 5,299,485 | 4/1994 | Denton | 84/329 |

*Primary Examiner*—Brian Sircus
*Assistant Examiner*—Shih-yung Hsieh
*Attorney, Agent, or Firm*—Blakely Sokoloff Taylor & Zafman LLP

[57] ABSTRACT

A pick holder that temporarily stores, protects and dispenses a pick that is used for plucking strings of a stringed musical instrument such as a guitar. The pick holder includes a first piece and a second piece that are coupled to cooperatively form a pocket for storing and dispensing one or more picks. The second piece is formed so that when the second piece is coupled to the first piece, the perimeter of the second piece provides access to the stored picks. The first piece forms a means of attaching the pick holder to a shoulder strap peg that is fixably coupled to the base of a musical instrument such as a guitar. The attachment means, formed by the first piece, enables the pick holder to be removably coupled to the shoulder strap peg.

11 Claims, 2 Drawing Sheets

PICK HOLDER

BACKGROUND OF THE INVENTION

1. Field of the Invention

The present invention generally relates to a pick holder that is adapted for the temporary storage and protection of a musical pick that is employed for plucking strings of a stringed musical instrument. The present invention specifically relates to a pick holder which is removably coupled to a peg fixably mounted to a stringed instrument or to a button on a shirt, a key ring, or other fixed reference object.

2. Description of the Related Art

The present invention relates to holders and, more particularly, to holders for plectra (i.e., more commonly known as picks).

A performer playing a stringed instrument, such as a guitar, usually uses a plectra (more commonly known as a pick) to excite the strings into a vibratory mode and produce musical notes. The pick often becomes misplaced during a performance, may break, or otherwise become unusable. For example, a performer may lose the pick into the interior of the guitar. Accordingly, ready access to additional picks is important.

Presently, performers maintain a supply of picks in their shirt pockets, on a table, chair or other surface near the performance area. Typically, a performance must be interrupted in order to find a substitute pick for the pick that is lost or damaged.

Also, performers and non-performers alike require a place to store picks between practicing and performances (especially with the instrument).

Furthermore, although there are prior art pick holders of various configurations (e.g., Tisher, U.S. Pat. No. 4,890,531; Vaughn, U.S. Pat. No. 4,785,708; and Rosen, U.S. Pat. No. 4,790,232), these holders are fixably coupled to the stringed instrument and cannot be removed from the instrument without damage to the wood finish on these instruments. For example, prior art holders employ adhesives and tapes to fixably mount either the pick holder or an assembly that receives the pick holder directly to the stringed instrument (i.e., the stringed instrument surface). As the stringed instruments are typically made out of expensive wood, it is desirable for a pick holder that is removably coupled to a stringed instrument without damage to the wood finish.

Because the prior art pick holders are fixedly coupled to the instrument, these holders are not portable. Furthermore, the prior art pick holders also are generally not attachable to other objects (e.g., one's clothing, key chain, etc.). Moreover, these prior art pick holders are generally awkward and difficult to install and use.

Accordingly, there remains an unmet need for a portable pick holder that can be removably attached to a stringed instrument without damage to the instrument and that is flexibly adapted to be removably coupled to other objects.

SUMMARY OF THE INVENTION

It is an object of the present invention to provide a pick holder of simple construction to store, protect, and dispense one or more picks.

It is a further object of the present invention to provide a pick holder that can be removably coupled to any target object such as a button on a piece of clothing (e.g., shirt), a key ring or other object.

It is another object of the present invention to provide a pick holder that is adapted to be removably coupled to a strap peg that is fixedly mounted on a stringed instrument without damage to the stringed instrument.

It is yet another object of the present invention to provide a pick holder for use on a guitar peg that reinforces and provides additional locking support for a guitar strap that is also removably coupled to the strap peg.

Accordingly, a pick holder of the present invention is configured to temporarily store, protect and dispense a musical pick that is used for plucking strings of a stringed instrument such as a guitar. The pick holder includes a first piece and a second piece that are coupled together to form or define a pocket for storing and dispensing picks. The first and second piece also define an opening. The first and second piece are sized and adapted to slidably receive one or more picks so that the pick can slide through the opening into the pocket and can be slidably removed from the pocket through the opening when use of the pick is desired. The first piece forms an attachment means for removably attaching the pick holder to a shoulder strap peg that is fixably coupled to the base of a musical instrument such as a guitar. The second piece includes a perimeter that is shaped and configured to allow access to the pocket when coupled together with the first piece.

In an alternative embodiment, the pick holder of the present invention is integrally formed with a strap (e.g., a guitar strap) that is adapted to be coupled to a stringed instrument, such as a guitar. In all other respects, the pick holder retains and dispenses picks and/or other objects as the first embodiment of the present invention.

In another embodiment, the pick holder of the present invention includes a lid that is coupled to the first piece. The lid has a closed position and an open position. In the closed position, the lid further secures an object placed in the pick holder. In the open position, picks and/or other objects stored in the pick holder can be dispensed. In this embodiment, a female and male counterpart of a button can be employed to snap close the lid so that it is coupled with the second piece in the closed position. In all other respects, the pick holder retains and dispenses picks and/or other objects as the first embodiment of the present invention.

These and other objects of the present invention will become more readily appreciated and understood from consideration of the following detailed description of the exemplary embodiments of the present invention when taken in conjunction with the accompanying drawings.

BRIEF DESCRIPTION OF THE DRAWINGS

The objects, features and advantages of the method and apparatus for the present invention will be apparent from the following description in which.

DETAILED DESCRIPTION OF THE INVENTION

Referring to the figures, exemplary embodiments of the invention will now be described. The exemplary embodiments are provided to illustrate aspects of the invention and should not be construed as limiting the scope of the invention. The exemplary embodiments are primarily described with reference to the figures.

Figure 1A:
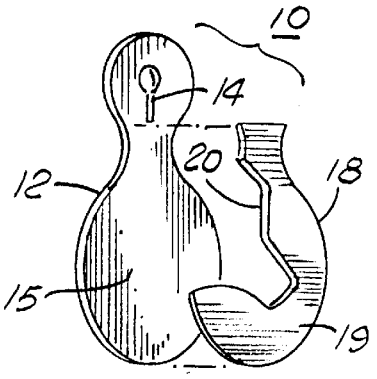
FIG. 1A is a perspective view of a first piece and a second piece employed in an exemplary embodiment of the pick holder of the present invention.
Figure 1B:
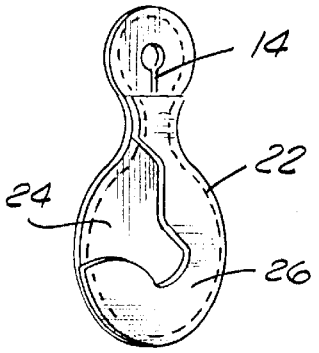
FIG. 1B is a perspective view of the exemplary embodiment of the present invention, shown in FIG. 1A, including means for attaching the first piece to the second piece.

FIGS. 1A and 1B illustrate an exemplary embodiment of a pick holder 10 configured in accordance with the teachings of the present invention. FIG. 1A illustrates that the pick holder 10 includes a first piece 12 and a second piece 18. The first piece 12 includes a first side 15 and a second side 16, which is shown in FIG. 3. The first piece 12 includes a head portion, a neck portion and a body portion. The head portion of the first piece 12 forms an attachment means 14 for removably coupling the pick holder 10 to a fixed target object. The fixed target object can be a shoulder strap peg that is fixably coupled to the base of a stringed instrument (e.g., a guitar), as will be illustrated in FIGS. 2–4.

In this embodiment, the attachment means 14 is an opening having a generally circular top portion and a generally vertical slit portion. It will be appreciated by those skilled in the art that alternative opening shapes, such as, a single generally vertical slit without a generally circular head portion, can be employed. Moreover, other means for attaching the pick holder 10 to a fixed target object, such as a loop made of string, cloth, a ring or a chain, can be used to attach pick holder 10 to the fixed target object.

The pick holder 10 also includes a second piece 18 having a first side 19 and a second side 20. In the preferred embodiment, the first piece 12 and the second piece 18 are made of leather. It will be appreciated by those skilled in the art that the first piece and the second piece can be constructed out of materials other than leather. These materials include plastic, cloth (e.g., natural fiber, such as cotton canvas, or man made fiber such as nylon), neoprene, vinyl, rubber, metal (sheet or screen), and paper (e.g., cardboard).

FIG. 1B is a perspective view of the exemplary embodiment of the present invention, shown in FIG. 1A, including means for attaching a first piece to a second piece of the pick holder. The first piece 12 and the second piece 18 are coupled together by coupling means 22. The coupling means shown in FIG. 1B is nylon thread that is stitched through the first piece 12 and second 18 piece.

The first piece 12 and the second piece 18 cooperate to form a pocket 26 for holding, storing and dispensing picks. The second piece 18 is formed having a contour or outline so that when the second piece 18 is coupled to the first piece 12, the pick holder 10 allows for easy access to the picks, while retaining the picks in the pocket 26.

The first piece 12 may or may not be lined with a nylon sheet 24. The first piece 12 and the second piece 18 are stitched together with a durable nylon thread. Moreover, it will be known by those skilled in the art that there are other conventional ways to couple the first piece 12 to the second piece 18 other than by using a thread stitching. For example, coupling means can be rivets, an adhesive, heat welds, or other well-known ways of attaching materials.

The preferred embodiment of the pick holder 10 comfortably holds 1 to 4 flat guitar picks of all thicknesses and sizes. The pick holder 10 can also hold a U.S. quarter dollar.

In an alternative embodiment, the first piece 12 and the second piece 18 can be integrally formed by molding process or, conceivably, an extruding process, when a material such as plastic is used to make the pick holder 10.

Figure 2:
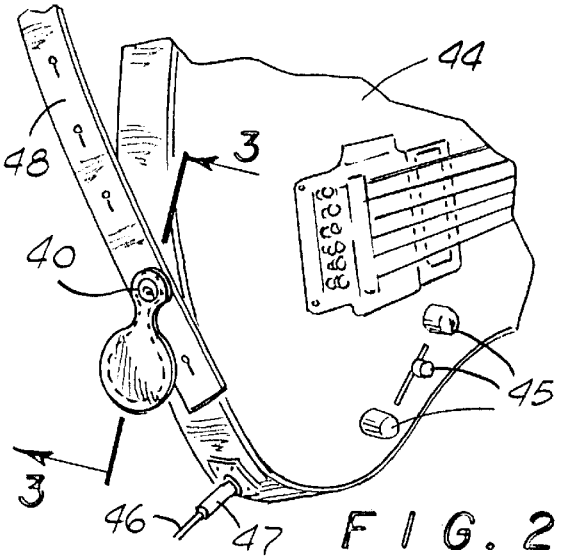
FIG. 2 is a perspective view of a guitar having the pick holder of the present invention mounted thereon.
Figure 3:
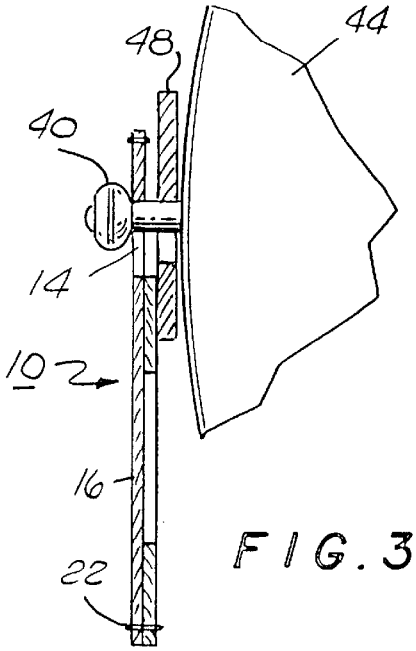
FIG. 3 is a section view taken along line 3—3 of FIG. 2.

FIG. 2 illustrates a perspective view of a guitar 44 having the pick holder 10 of the present invention mounted thereon. The pick holder 10 of the present invention can be used in conjunction with a fixed target object (e.g., shoulder strap peg 40) at the base of a guitar 44. The pick holder 10 of the present invention is easy to use by both right-handed and left-handed guitarists. Since the pick holder 10 is adapted to couple to different shaped and sized guitar strap pegs which typically do not vary much in size and shape, the pick holder 10 is compatible with all guitar types including acoustic, electric, bass, etc. since the instrument type is not dependent on guitar strap peg configurations.

Figure 4:
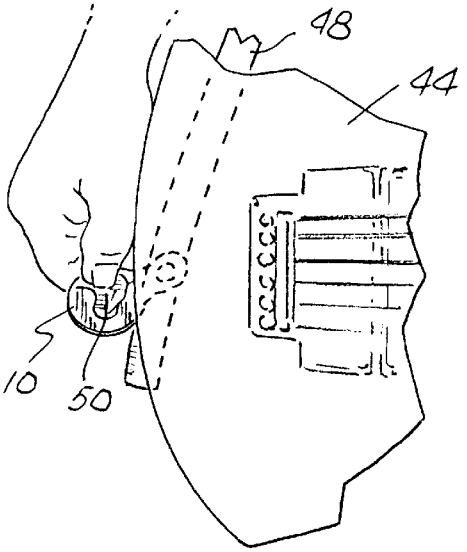
FIG. 4 is a perspective view illustrating a guitar having the pick holder of the present invention mounted thereon and further illustrating how one can access a pick stored in the pick holder of the present invention.

It is important for the pick holder 10 to attach snugly to the shoulder strap peg 40 at the base of the guitar either before or after the shoulder strap 48. It is preferred that the pick holder 10 is attached after the shoulder strap 48, as shown in FIGS. 2–4, so that the pick holder 10 provides additional "lock" protection for the shoulder strap 48. In other words, the pick holder 10, when attached after the shoulder strap 48, ensures that the shoulder strap will not become detached from the shoulder strap peg accidentally.

The fixed target object can also be a knob stem (not shown), disposed on an electrical guitar or an electric amplifier. A knob 45 (e.g., volume, etc.) can lock the pick holder 10 in place. Also, the fixed target object can be an amplifier cord 46 or the amplifier cord connector 47 which is coupled to an electric guitar. The pick holder 10 can be removably coupled to any of these objects.

The fixed target object can also be a button on a piece of clothing, a stem of a belt buckle, a keychain or keyring, or any target object that can be threaded through the attachment means 14. The pick holder 10 can be removably coupled to any of these target objects.

FIG. 3 is a section view taken along line 3—3 of FIG. 2. FIG. 3 further illustrates the preferred embodiment in which the pick holder 10 is attached to the shoulder strap peg 40 after the shoulder strap 48 is coupled to the strap peg 40.

FIG. 4 is a perspective view illustrating a guitar 44 having the pick holder 10 of the present invention mounted thereon and further illustrating how one can access a pick 50 stored in the pick holder 10 of the present invention.

Figure 5:
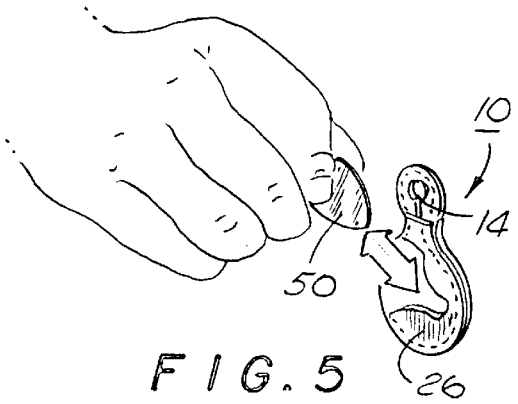
FIG. 5 is a perspective view illustrating an exemplary embodiment of the present invention and further illustrating how a pick is stored into and dispensed from the pick holder of the present invention.

FIG. 5 further illustrates how picks 50 are stored into and removed from the pocket 26 of the pick holder 10. For example, picks 50 can be removed from and stored into the pocket 26 of pick holder 10 with a thumb and forefinger.

For right-handed guitarists, picks are dispensed from the pick holder 10 toward the front of the instrument inches away from the playing area. Consequently, when the player needs a new pick, the player can easily obtain a pick from the pick holder 10.

The pick holder 10 does not affect the sound of the guitar nor does it interfere with a guitar's playing characteristics or style since the pick holder 10 is not coupled directly to the face of the guitar and is instead in an out of the way location far from where the picking and strumming occurs.

The pick holder 10 can accommodate different sized picks and can be removably coupled to different guitar types and instrument types. The pick holder 10 of the present invention attaches to an instrument in an unobtrusive manner and has a simple, two-piece design that is inexpensive to manufacture. Although the pick holder 10 is disposed in a location that is unobtrusive and not disruptive of a guitarist's playing of the instrument, the pick holder 10 is disposed in a location close enough to the playing area so that the guitarist can quickly access a new pick and return to playing the instrument with minimal interruption.

Figure 6:
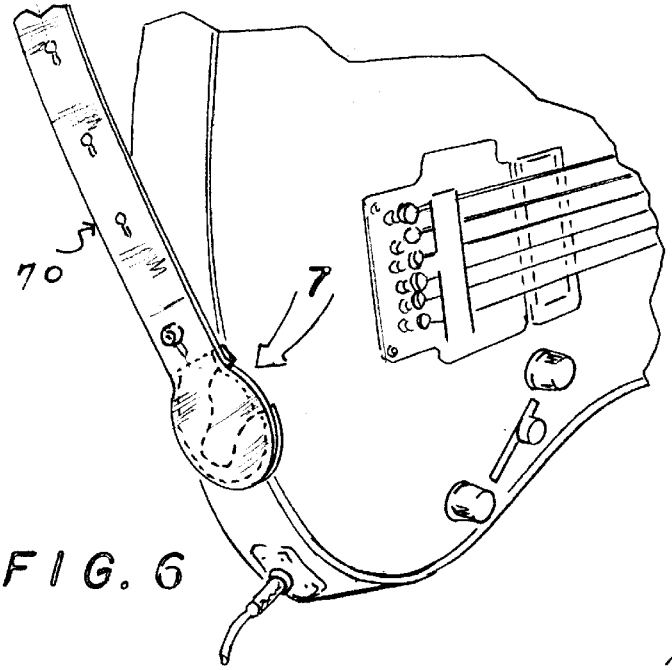
FIG. 6 is a perspective view of a guitar having an alternative embodiment of the pick holder of the present invention mounted thereon.
Figure 7:
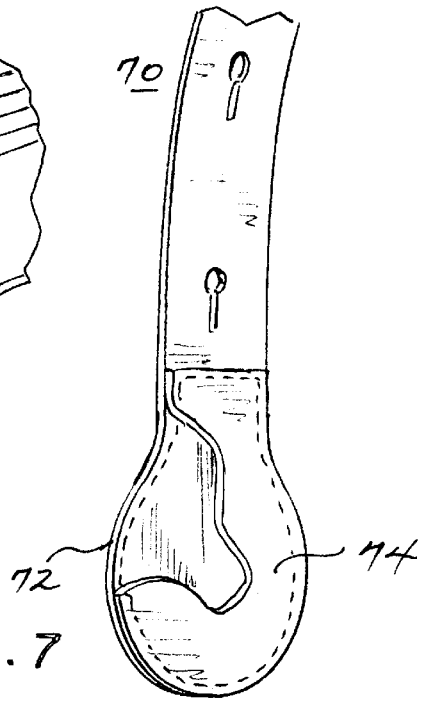
FIG. 7 is a perspective view of the alternative embodiment of the pick holder of the present invention, shown in FIG. 6.

FIGS. 6 and 7 illustrate an alternative embodiment of the pick holder 70 of the present invention. FIG. 6 is a perspective view of a guitar having the alternative embodiment of the pick holder 70 of the present invention mounted thereon. FIG. 7 is a perspective view illustrating this embodiment of the pick holder 70 of the present invention. In this alternative embodiment, the pick holder 70 is either fixably coupled to a strap (e.g., a guitar strap) or integrally formed as part of the strap. In this alternative embodiment, a first piece 72, which includes a strap, and the second piece 74 are coupled to form an object or pick receiving pocket. This embodiment 70 is especially suited for musicians who always employ a guitar strap when playing. The first embodiment 10 is more flexible in that picks are provided even when the guitar strap is not employed.

Figure 8:
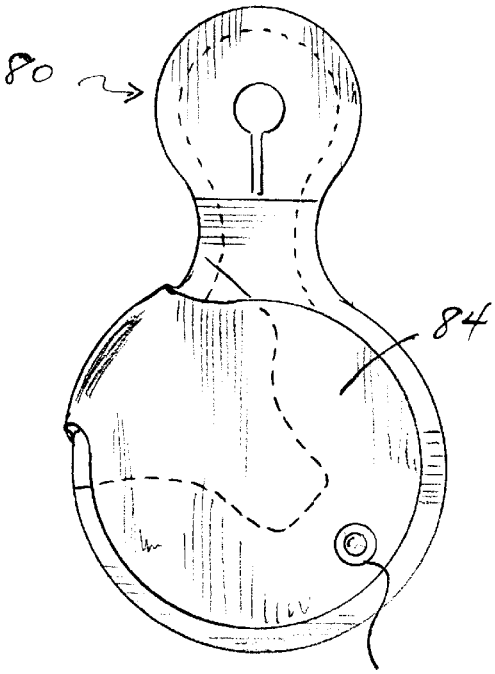
FIG. 8 illustrates another embodiment of the pick holder of the present invention.
Figure 9:
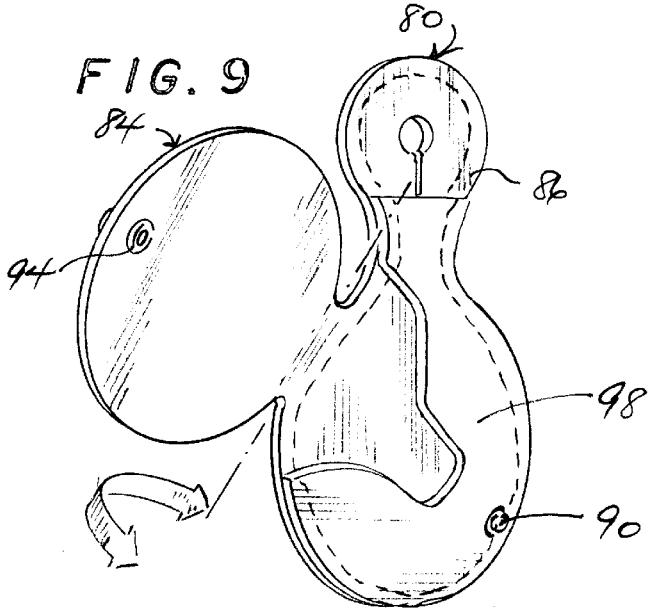
FIG. 9 is a perspective view of the embodiment of the pick holder of the present invention, shown in FIG. 8.

FIGS. 8 and 9 illustrate another embodiment of the pick holder 80 of the present invention. In this embodiment, the pick holder 80 of the present invention includes a lid 84 that covers a pick dispensing area. The lid 84 can be integrally formed with a first piece 86 or can be a separate piece that is attached to the first piece 86 with a suitable material such as stitching (not shown). FIG. 8 illustrates this embodiment 80 of the present invention when the lid 84 is in a closed position. FIG. 9 illustrates perspective view of this embodiment 80 of the present invention with the lid 84 in an open position. In this embodiment, a snap-close button 88 is employed to couple the lid 84 to a second piece 98 when in the closed position. The button 88 includes a male component 90 that is disposed on the second piece 98, and a female component 94 that is disposed on the lid 84. The lid 84 further insures that the objects or picks stored in the pick holder will not fall out of the pick holder 80. The lid 84 further secures and retains the picks and/or other objects stored in the pick holder.

It is appreciated that the pick holder of the present invention is of simple construction and can easily store, protect and dispense one or more musical picks. In one embodiment, the pick holder 10 is removably coupled to the shoulder strap peg 40 located at the base of the musical instrument such as a guitar 44. In another embodiment, the pick holder 70 is integrally formed or fixably coupled to a strap that is adapted to couple to a strap peg. In yet another embodiment, the pick holder 80 includes a snap-close lid for further securing the picks or objects stored in the pick holder.

Accordingly, the present invention has been described with some degree of particularity directed to the exemplary embodiments of the present invention. The exemplary embodiments described herein are provided merely to illustrate the principles of the invention and should not be construed as limiting the scope of the invention. It should be appreciated, though, that the present invention is defined by the following claims construed in light of the prior art so that modifications or changes may be made to the exemplary embodiments of the present invention without departing from the inventive concepts contained herein.

I claim:

1. A pick holder removably coupleable to a single peg, said peg fixably mounted to a stringed instrument, said pick holder comprising:

means for removably attaching said pick holder to said peg; and means coupled to attachment means, for receiving, holding and providing a pick, wherein the means for receiving, holding and providing a pick further includes means for further securing said pick in said pick holder.

2. The pick holder of claim 1, wherein said stringed instrument is a guitar.

3. A pick holder removably coupleable to a single peg, said peg fixably mounted to a stringed instrument, said pick holder comprising:

means for removably attaching said pick holder to said peg; and means coupled to attachment means, for receiving, holding and providing a pick, wherein said peg is a strap peg, receiving an end of a strap, said strap employed to support said stringed instrument against a player's body.

4. A pick holder comprising:

a first piece, said first piece including means for attaching said pick holder to a stringed instrument;

a second piece;

means for attaching said first and second piece together; and a lid, coupled to the first piece, said lid having a closed position and an open position wherein said first and second piece cooperate to define a pocket, said pocket for receiving and holding a pick.

5. The pick holder of claim 4 wherein the lid is coupled to the second piece in the closed position and is not coupled to the second piece in the open position.

6. The pick holder of claim 4 wherein said means for attaching said first piece and said second piece is sewing thread.

7. The pick holder of claim 4 further including a snap-close button having a male part disposed on said second piece and a female component disposed on said lid, said male and female parts in contact when the lid is in the closed position.

8. A pick holder comprising:

a first piece, said first piece including means for attaching said pick holder to a stringed instrument;

a second piece; and means for attaching said first and second piece together; wherein said first and second piece cooperate to define a pocket, said pocket for receiving and holding a pick and wherein said stringed instrument is a guitar wherein the attachment means for attaching said pick holder to said stringed instrument is a slit in said first piece.

9. A pick holder comprising:

a first piece, said first piece including means for attaching said pick holder to a stringed instrument;

a second piece; and means for attaching said first and second piece together; wherein said first and second piece cooperate to define a pocket, said pocket for receiving and holding a pick and wherein said first piece defines an opening for receiving a peg, said peg fixably mounted on said stringed instrument.

10. A pick comprising:

a first piece, said first piece including means for attaching said pick holder to a stringed instrument;

a second piece; and means for attaching said first and second piece together; wherein said first and second piece cooperate to define a pocket, said pocket for receiving and holding a pick and wherein said attachment means defines a generally circular hole and slit in said first piece.

11. A guitar pick holder comprising:

a first piece, said first piece including means for attaching said pick holder to a stringed instrument;

a second piece; and means for attaching said first and second piece together; wherein said first and second piece cooperate to define a pocket, said pocket for receiving and holding a pick and wherein said attachment means removably engages a generally cylindrical peg having a circumference slightly less than circumference of the general circular hole.

* * * * *

UNITED STATES PATENT AND TRADEMARK OFFICE

CERTIFICATE OF CORRECTION

PATENT NO. : 5,905,217

DATED : May 18, 1999

INVENTOR(S) : Byers

It is certified that error appears in the above-identified patent and that said Letters Patent is hereby corrected as shown below:

In column 7, claim 10 at line 4, delete -- A pick comprising: -- and insert -- A pick holder comprising: --.

Signed and Sealed this

Eleventh Day of April, 2000

*Attest:*

*Attesting Officer*

Q. TODD DICKINSON

*Director of Patents and Trademarks*